US005437487A

United States Patent [19]

Fulop

[11] Patent Number: 5,437,487

[45] Date of Patent: Aug. 1, 1995

[54] GOLF BALL RETRIEVER

[76] Inventor: Charles Fulop, 17664 Candlewood Ter., Boca Raton, Fla. 33487

[21] Appl. No.: 250,540

[22] Filed: May 31, 1994

[51] Int. Cl.[6] ..... A63B 47/02

[52] U.S. Cl. ..... 294/19.2

[58] Field of Search ..... 294/19.1, 19.2, 66.1, 294/99.1; 56/327.1, 328.1, 332, 400.11; 273/32 F, 162 E

[56] References Cited

U.S. PATENT DOCUMENTS

| | | | |
|---|---|---|---|
| 704,848 | 7/1902 | Minton | 294/19.2 |
| 2,561,815 | 7/1951 | Oberg | 294/19.2 |
| 3,026,666 | 3/1962 | Baugh | 294/19.2 X |
| 3,046,044 | 7/1962 | Christle | 294/19.2 |
| 3,258,286 | 6/1966 | Coward | 294/19.2 |
| 3,442,544 | 5/1969 | Faber | 294/19.2 |
| 3,770,308 | 11/1973 | Faber et al. | 294/19.2 |
| 3,887,225 | 6/1975 | McKee | 294/19.2 |
| 3,922,026 | 11/1975 | Schweitzer | 294/19.2 |
| 3,982,781 | 9/1976 | Tucker et al. | 294/19.2 |
| 4,063,769 | 12/1977 | Zimmer | 294/19.2 |
| 4,184,707 | 1/1980 | Nelson et al. | 294/19.2 |
| 4,334,707 | 6/1982 | Phillips | 294/19.2 |
| 4,493,503 | 1/1985 | Jeninga | 294/19.2 |
| 4,659,125 | 4/1987 | Chuan | 294/19.2 |
| 4,728,134 | 3/1988 | Allen | 294/19.2 |
| 4,787,632 | 11/1988 | Nigrelli | 273/32 B |
| 5,188,409 | 2/1993 | Ferey | 294/19.2 |

*Primary Examiner*—Johnny D. Cherry
*Attorney, Agent, or Firm*—Alvin S. Blum

[57] ABSTRACT

A golf ball retriever includes an elongate telescoping handle to which is attached a frame defining a golf ball entrance plane to be positioned over a golf ball. The dimensions of the plane are large relative to the diameter of the ball so that it is easily positioned under adverse conditions of visibility. A U-shaped hoop connected at both ends to the frame defines a ball-retaining chamber having openings large enough to freely pass mud and debris but too small to pass the ball. An elastic member or spring extends at least partly across the entrance plane, thereby dividing the entrance plane into two parts, neither of which is large enough to permit passage of the ball unless the spring is forced aside. The spring is arranged to be readily forced aside when the frame is pushed onto the ball to admit the ball to the ball-retaining chamber. The spring is stiff enough to prevent spontaneous release of the ball from the chamber.

15 Claims, 2 Drawing Sheets

FIG. 1
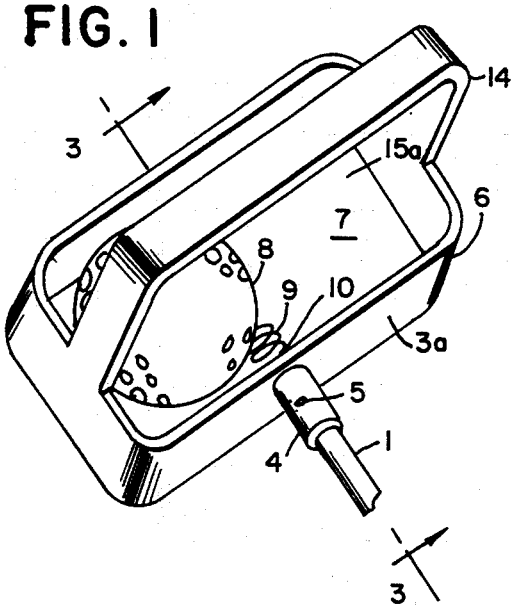
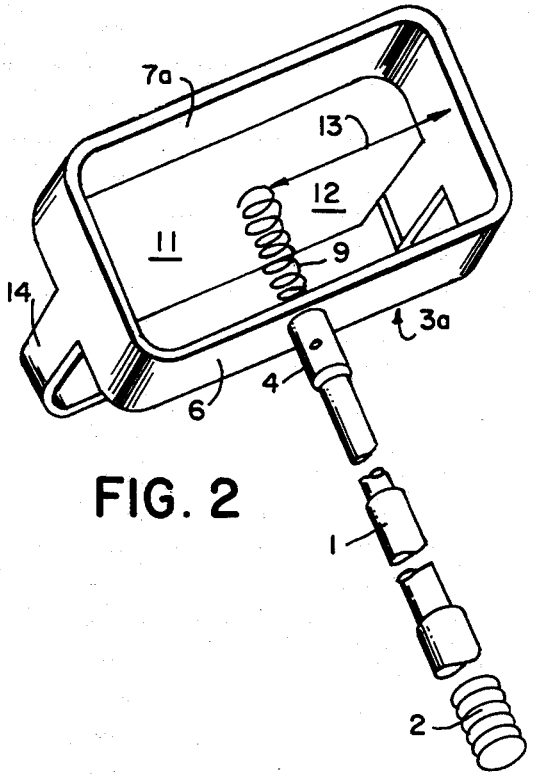
FIG. 2
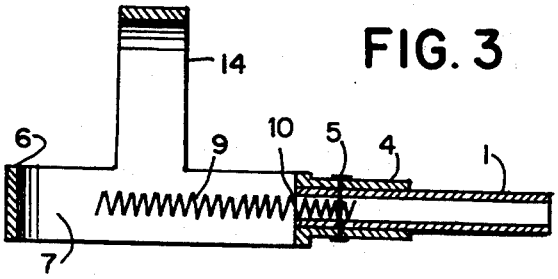
FIG. 3
FIG. 4
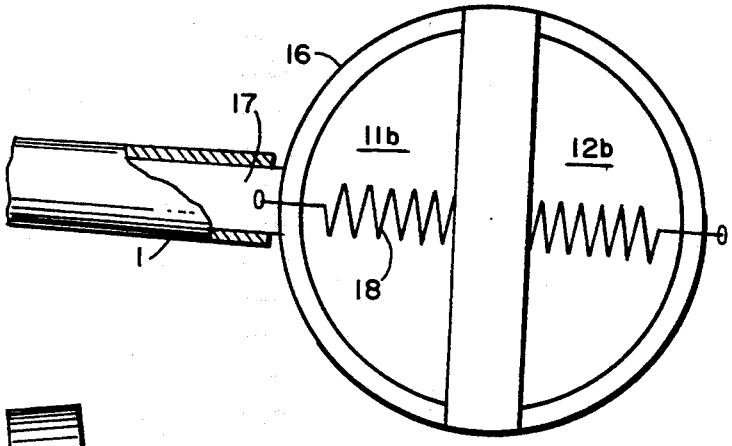
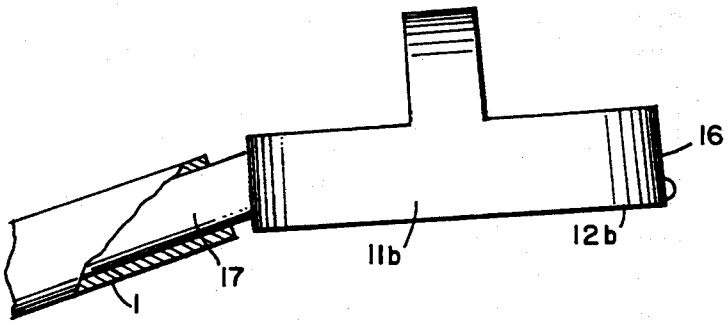
FIG. 5

FIG. 6
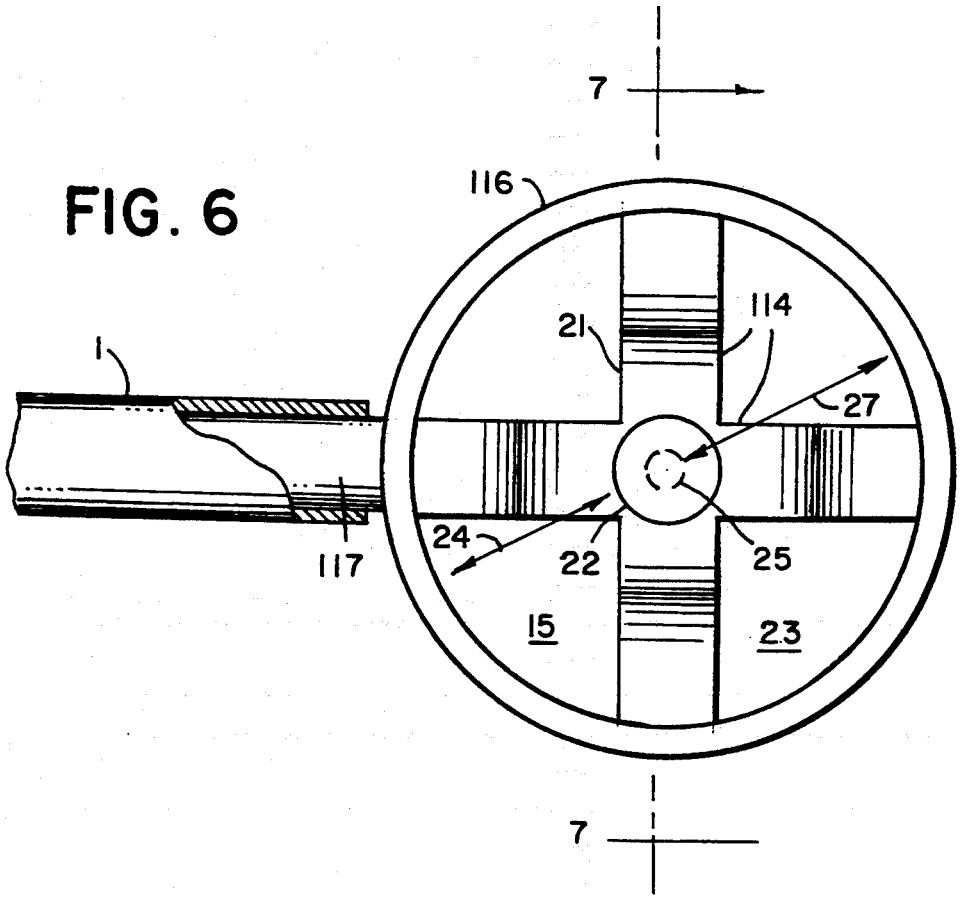
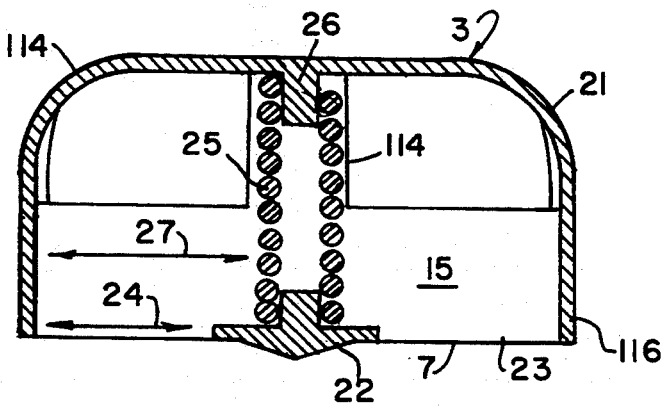
FIG. 7

GOLF BALL RETRIEVER

This invention relates to devices for retrieving golf balls from bodies of water and other areas that are relatively inaccessible.

BACKGROUND OF THE INVENTION

In the game of golf, various obstacles are presented on the course to make successful play more challenging. These may include overgrown vegetation, sand traps, and water hazards. When the ball can be seen, but not reached conveniently, such as in a body of water, the player may be confronted with the loss of the costly ball or employing various implements to retrieve the ball. The U.S. Pat. No. 5,188,409 issued Feb. 12, 1993 to Ferey provides a review of the prior art golf ball retrievers, which are complex and expensive. The retrievers of the prior art generally have a ball receiving aperture that is only slightly larger than the ball diameter. In order to operate these devices successfully, the user must be able to locate the ball and position the retriever over it quite precisely. Because of the refraction of light at the water air interface, this is not easily done. Furthermore, the water surface may be disturbed by wind, also hindering precise positioning of the retriever. Any moving parts are easily disturbed by the sand, mud and other elements to which the device will be exposed in normal operation.

SUMMARY OF THE INVENTION

It is, accordingly, an object of the invention to provide a golf ball retriever that is inexpensive and simple in operation. It is another object that the aperture for receiving the ball be much greater than the ball diameter to facilitate retrieval when visibility is difficult.

The retriever of the invention comprises a telescoping elongate handle, one end of which is attached to a frame having an aperture greater than the diameter of the ball arranged for receiving the ball therethrough. A resilient spring is attached at one end to the frame and extends across the plane of the frame aperture, effectively dividing the aperture into two portions of substantially equal size. Each of those portions has at least one dimension that is less than the diameter of the ball, so that the ball can only pass the aperture by displacing the spring. A U-shaped hoop attached to the frame retains the ball by defining a ball holding space beyond the aperture. To operate the device, one need only position the frame over the ball and push it down. The ball forces the spring aside as it passes through the aperture. The spring then snaps back to its original position after the ball has passed the aperture, thereby securely retaining the ball in the ball retaining space without any special manipulation by the operator. The user removes the ball from the space by simply pulling the ball past the spring.

In an alternative embodiment, a large diameter circular frame has a spring-mounted center piece dividing the entrance plane into an annulus too small to pass the ball until the center piece is forced aside.

These and other objects, advantages and features of the invention will become more apparent when the detailed description of the invention is considered in conjunction with the drawings.

BRIEF DESCRIPTION OF THE DRAWINGS

FIG. 1 is a perspective view of a retriever of the invention with a golf ball engaged.

FIG. 2 is a perspective view of the retriever of FIG. 1 inverted.

FIG. 3 is a sectional view, taken through line 3—3 of FIG. 1.

FIG. 4 is a top view of another embodiment of the invention with portions of the handle broken away.

FIG. 5 is a side elevation view of the retriever of FIG. 4.

FIG. 6 is a bottom view of another embodiment of the invention.

FIG. 7 is a sectional view, taken through line 7—7 of FIG. 6.

DETAILED DESCRIPTION OF PREFERRED EMBODIMENTS

Referring now first to FIGS. 1–3, the retriever of the invention comprises a telescoping tubular handle 1 with grip 2 at one end and a ball holding assembly 3*a* at another end. The ball holding assembly 3*a* includes a handle connector 4 which may be fixed to the handle by fastener 5 or adhesive or other means well known in the art. Attached to the handle connector 4 is a frame 6 defining an entrance plane 7*a* through which the ball passes. The dimensions of the entrance plane 7*a* are great enough so that the golf ball 8 passes freely therethrough without requiring precise positioning of the retriever over the ball. A resilient midline spring 9 is affixed at one end 10 to the frame 6 by anchoring it within the tubulation of handle connector 4 which receives the handle 1. The spring 9 divides the entrance plane 7*a* into two substantially equal parts 11*a* and 12*a* which have a small dimension 13 too small to permit passage of the ball, i.e. less than the diameter of the regulation golf ball of approximately 42 millimeters. The spring has sufficient elasticity to be readily forced aside when the frame is forced down on the ball. It has sufficient stiffness to prevent the weight of the ball from forcing the spring aside when the frame is lifted. A rigid, generally U-shaped hoop 14 is attached to the frame 6 at two points. It defines, in combination with frame 6, a ball chamber 15*a* having openings too small to permit passage of the retained ball, yet large enough to pass mud and debris. Consequently., once a ball has moved past the entrance plane by moving aside spring 9, it will be held securely within the chamber 15*a* for secure retrieval. The ball is removed by pulling it out through the entrance plane, thereby forcing spring 9 aside.

Referring now to FIGS. 4 and 5, an alternative embodiment of the invention is shown having a more nearly circular frame 16 with a male connector 17 for the tubular handle 1. The handle connector 17 is attached at an angle of approximately 15 degrees to the frame. An elastic member 18 which may be a spring or other elastic element such as a resilient plastic rod well known in the art is attached at both ends to the frame. The operation is substantially the same, with the elastic element 18 dividing the entrance plane into two parts 11*b* and 12*b* which can only pass a ball when the elastic element is displaced.

Referring now to FIGS. 6 and 7, an alternative embodiment of the invention is shown with a circular frame 116 and a male connector 117 for a handle 1, wherein crossed hoops 114 close off enough of the top 21 to prevent escape of the ball.

The entrance plane 7 is partially occluded by a spring biased center piece 22 so that an annular entrance plane 23 is formed whose width 24 is slightly smaller than the ball diameter. The center piece is attached by a springy stalk 25 to the center point 26 of hoops 114. When the ball holding assembly 3 is pressed onto a ball, the center piece 22 is forced aside and the ball moves into the space past the entrance plane 7. The diameter of stalk 25 is so much less than that of center piece 22 that width 27 of the space behind the annular entrance plane 23 is greater than the ball diameter. Consequently, when the ball moves past the entrance plane, the center piece 22 springs freely back to the central position, capturing the ball within the ball chamber 15. The retrieved ball is released by manually forcing the center piece 22 aside as the ball is pulled out past the entrance plane.

The above disclosed invention has a number of particular features which should preferably be employed in combination although each is useful separately without departure from the scope of the invention. While I have shown and described the preferred embodiments of my invention, it will be understood that the invention may be embodied otherwise than as herein specifically illustrated or described, and that certain changes in the form and arrangement of parts and the specific manner of practicing the invention may be made within the underlying idea or principles of the invention within the scope of the appended claims.

I claim:

1. A retriever for removably engaging a golf ball having a predetermined diameter, the retriever comprising:

a handle affixed at one end to a rigid frame means;

said frame means defining an entrance plane for passage of a golf ball therethrough, said entrance plane having dimensions so much greater than said predetermined ball diameter that said frame means may be positioned over said ball without difficulty for subsequent passage of said ball through said entrance plane;

a single elongate elastic member extending sufficiently across the center of said entrance plane to divide said entrance plane into areas, each of said areas having at least one dimension that is less than the diameter of said ball, said elastic member having an unattached first end, and being attached at a second end to said frame means;

an elongate hoop member having two ends attached to said frame means and extending away from said entrance plane, said hoop member and said frame means defining a ball-retaining chamber having large openings, none of which are great enough to permit passage of said ball therethrough, said elastic member being arranged to be readily displaced by said ball when said frame means is forced onto said ball to permit ball passage into said ball-retaining chamber and said elastic member being arranged to resiliently return to a position dividing said entrance plane into areas having dimensions which prevent free passage of said ball from said ball-retaining chamber.

2. The retriever according to claim 1, in which said elastic member is a spring attached at one end to said frame means.

3. The retriever according to claim 2, in which said hoop member is generally U-shaped.

4. The retriever according to claim 3, in which said handle is affixed to said frame means by a tubular element connected to said frame means.

5. The retriever according to claim 4, in which said handle comprises telescoping tubes.

6. The retriever according to claim 5, in which said elastic member divides said entrance plane into two substantially equal parts when said elastic member is not stressed.

7. A retriever for removably engaging a golf ball having a predetermined diameter, the retriever comprising:

a handle affixed at one end to a rigid frame means;

said frame means defining an entrance plane for passage of a golf ball therethrough, said entrance plane having dimensions so much greater than said predetermined ball diameter that said frame means may be positioned over said ball without difficulty for subsequent passage of said ball through said entrance plane;

a single elongate occluding means having two ends, and elastically supported at said entrance plane to partially occlude said entrance plane, the partially occluded entrance plane having at least one dimension that is less than the diameter of said ball;

a hoop member having ends attached to said frame means and extending away from said entrance plane, said hoop member and said partially occluded entrance plane cooperating to define a ball retaining chamber having dimensions for free movement of said ball therein and having large openings, none of which are great enough to permit passage of said ball therethrough;

said occluding means having an unattached first end, and being elastically attached at a second end to a support structure selected from the group of support structures consisting of said hoop member and said frame means and said occluding means arranged to be readily elastically displaced by said ball when said frame means is forced onto said ball to permit said ball to pass through said entrance plane and into said ball retaining chamber and said occluding means arranged to thereupon resiliently return to a position partially occluding said entrance plane into dimensions which prevent free passage of said ball from said ball retaining chamber.

8. The retriever according to claim 7, in which said hoop member is generally U-shaped.

9. The retriever according to claim 8, in which said handle comprises telescoping tubes.

10. The retrieve according to claim 7, in which said elastic element is a spring.

11. The retriever according to claim 10, in which said spring divides said entrance plane into two substantially equal parts when said spring is not stressed.

12. The retriever according to claim 7, in which said elastic element divides said entrance plane into two substantially equal parts when said occluding means is not stressed.

13. The retriever according to claim 7, in which said frame means is substantially circular and said occluding means is centrally mounted within said entrance plane.

14. A retriever for removably engaging a golf ball having a predetermined diameter, the retriever comprising:

a handle affixed at one end to a rigid frame means;

said frame means defining an entrance plane for passage of a golf ball therethrough, said entrance plane having dimensions so much greater than said predetermined ball diameter that said frame means may be positioned over said ball without difficulty for subsequent passage of said ball through said entrance plane;

occluding means elastically supported at said entrance plane to partially occlude said entrance plane, the partially occluded entrance plane having at least one dimension that is less than the diameter of said ball;

a hoop member having ends attached to said frame means and extending away from said entrance plane, said hoop member and said partially occluded entrance plane cooperating to define a ball retaining chamber having dimensions for free movement of said ball therein and having large openings, none of which are great enough to permit passage of said ball therethrough;

said occluding means being elastically attached to said hoop member, said occluding means arranged to be readily elastically displaced by said ball when said frame means is forced onto said ball to permit said ball to pass through said entrance plane and into said ball retaining chamber and said occluding means arranged to thereupon resiliently return to a position partially occluding said entrance plane into dimensions which prevent free passage of said ball from said ball retaining chamber, said occluding means being centrally mounted within said entrance plane, and said occluding means being resiliently connected by an elongate elastic member to said hoop member.

15. The retriever according to claim 14, in which said handle includes telescoping tubes.

* * * * *